US007290493B2

(12) United States Patent
Suzuki et al.

(10) Patent No.: US 7,290,493 B2
(45) Date of Patent: Nov. 6, 2007

(54) SEWING MACHINE

(75) Inventors: Kenji Suzuki, Aichi-ken (JP); Takashi Shibata, Inuyama (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 0 days.

(21) Appl. No.: 11/553,530

(22) Filed: Oct. 27, 2006

(65) Prior Publication Data

US 2007/0101914 A1 May 10, 2007

(30) Foreign Application Priority Data

Nov. 7, 2005 (JP) ..... 2005-321884

(51) Int. Cl.
*D05B 69/10* (2006.01)
*D05B 29/02* (2006.01)

(52) U.S. Cl. ..... 112/220

(58) Field of Classification Search ..... 112/220, 112/221, 235, 237, 98, 155
See application file for complete search history.

(56) References Cited

U.S. PATENT DOCUMENTS 5,899,157 A * 5/1999 Kurono et al. ..... 112/470.01
6,073,567 A * 6/2000 Aoki ..... 112/237

FOREIGN PATENT DOCUMENTS

JP 408299963 A * 11/1996
JP 410146484 A * 6/1998
JP 02005334329 A * 2/2007

* cited by examiner

*Primary Examiner*—Ismael Izaguirre
(74) *Attorney, Agent, or Firm*—Rossi, Kimms & McDowell LLP

(57) ABSTRACT

Sewing machine includes: a needle bar driven to move up and down to perform sewing operation; a jump mechanism electrically controlled to bring the needle bar to a jump sewing state; a holder member controlled to move, in synchronism with the up-and-down movement of the needle bar, for holding a sewing workpiece from above when the holder member is in its lowered position; and a holder mechanism for, when the sewing operation is to be stopped, moving the holder member upward to a predetermined evacuating position and mechanically retaining the holder member in the evacuating position; and an interlocking mechanism for mechanically retaining the needle bar in the jump sewing state in interlocked relation to the holder member being mechanically retained in the evacuating position. Thus, even when a sudden power failure has occurred, the needle bar of each machine head set in a resting state can be reliably retained in the jump sewing state, which can avoid deformation or breakage of component parts that might result from undesired descending movement of the needle bar.

7 Claims, 7 Drawing Sheets

SEWING MACHINE

BACKGROUND OF THE INVENTION

The present invention relates generally to a sewing machine provided with a machine head capable of sewing a string-shaped sewing material, such as a tape or cord, onto a fabric or other sewing workpiece through lock switching. More particularly, the present invention relates to an improved sewing machine that can bring a desired machine head to a non-operating or resting state by placing a needle bar in a jump sewing state.

Heretofore, there have been known multi-head sewing machines equipped with a plurality of machine heads, each of which includes: a vertically-driven needle bar having a sewing needle fixed to the lower end thereof, a fabric holder member movable vertically (i.e., in an up-down direction) in synchronism with the up-and-down movement of the needle bar; a rotary member provided concentrically with the needle bar and rotatable about the axis of the needle bar; and a guide rotatable together with the rotary member for directing a string-shaped sewing material toward the point of the sewing needle (i.e., needle point). Each of such machine heads is capable of sewing a string-shaped sewing material onto the sewing workpiece by lock stitching while controlling the rotation of the rotary member in accordance with a moving direction of a sewing workpiece based on predetermined embroidery data and adjusting the orientation of the guide so that the string-shaped sewing material can be appropriately directed toward the point of the sewing needle. Among examples of such sewing machines equipped with machine heads capable of sewing string-shaped sewing materials is one disclosed in Japanese Patent Application Laid-open Publication No. HEI-8-299639.

In order to rest or stop operation of the machine head in the sewing machine disclosed in the HEI-8-299639 publication, it is necessary to not only cut off, via a jump mechanism, transmission of a rotational driving force from a main shaft of the machine to the needle bar to thereby set the needle bar in a "jump sewing state" where the needle bar is prevented from moving in an up-down direction in response to rotation of the main shaft, but also evacuate upward the fabric holder member. Namely, the machine's main shaft extends through the machine head, and the machine head includes a needle bar mechanism that sews a string-shaped sewing material onto a sewing workpiece by moving the needle bar of the machine head up and down through controlled rotation, by a machine motor, of the main shaft. The machine head further includes the jump mechanism that cuts off the driving force transmission from the main shaft to the needle bar. As well known in the art, the jump mechanism is of a motor-driven type controlled by electrical signals. Drive arm is fixed to the shaft of a jump controlling motor provided on the machine head, and the drive arm is caused to pivot, by the jump controlling motor responsive to a predetermined jump sewing signal (electrical signal), between a predetermined standby position and a predetermined jump-effecting position. The drive arm is normally urged, by a biasing means, to be located in the standby position. As the drive arm pivots to the jump-effecting position, a lifting/lowering drive member for vertically moving the needle bar up and down is rotated, so that the lifting/lowering drive member and the needle bar are operatively disconnected from each other and thus the needle bar is brought to the "jump sewing state" to stop its up-and-down movement. By the needle bar brought to the jump sewing state during the course of sewing, it is possible to form a long stitch, i.e. perform so-called "jump sewing". Further, by continuously keeping the needle bar in the jump sewing state, the operation of the machine head itself can be stopped.

In addition to the jump controlling motor, the machine head is provided with a holder controlling motor for moving the fabric holder member up and down. During sewing operation of the sewing machine, the holder controlling motor vertically drives the fabric holder member in synchronism with the up-and-down movement of the needle bar, while, during rest or stoppage of the sewing machine, the holder controlling motor evacuates the fabric holder member far above a normal sewing stroke. While the fabric holder member is in the evacuating position and even when the holder controlling motor can not appropriately drive the fabric holder member for some reason, the fabric holder member lowers or descends in response to the downward movement of the needle bar by a component part, fixed to the needle bar, hitting a component part of a fabric holder drive mechanism as the needle bar driven by the main shaft descends, so as to avoid possible troubles, such as breakage of component parts.

In case there has occurred a sudden power failure during operation of the sewing machine, all of the motors driving the sewing machine stop operating or shut down. Of course, the machine motor, driving the main shaft, also stops operating; however, in the case of the motor stoppage due to a power failure or the like, the main shaft would continue to rotate for a while due to inertia, so that the needle bar moves up and down several times. Further, in some cases, the multi-head sewing machine is operated with just one or some of the plurality of machine heads, each capable of sewing a string-shaped sewing material, caused to operate with the remaining machine heads set in a resting state. In case there has occurred a sudden power failure during such operation of the multi-head sewing machine, not only the needle bar in each machine head set in the operating state but also the needle point in each machine head set in the resting state would move vertically up and down. Because, as noted above, desired stoppage of any of the machine heads is effected by the jump controlling motor driving the needle bar to shift to the jump sewing state and the jump controlling motor too stops operating due to the power failure, so that the drive arm is caused to pivot to the standby position, by means of the biasing means, to cancel the jump sewing state. Although the fabric holder member is evacuated upward in each machine head set in the resting state as noted above, the fabric holder member too descends if the needle bar descends, so that troubles, such as breakage of component parts, due to collision between the needle bar mechanism and the fabric holder mechanism.

However, if, in the multi-head sewing machine with only one or some of the plurality of machine heads operating with the remaining machine heads set in the resting state, the needle bars set in the non-operating state descend due to a power failure or the like during operation of the machine, there would occur a possibility of some component parts being deformed or broken. Namely, in the case where only one or some of the plurality of machine heads are in the operating state, a side of a rectangular-shaped embroidery frame, holding the sewing workpiece, may be located under any of the machine heads set in the resting state as the sewing machine operates. Thus, if the needle bars and fabric holder members of the machine heads set in the resting state descend due to a power failure or the like when a side of the embroidery frame is located under any of the machine heads set in the resting state, there would occur a significant inconvenience that the needle bar and fabric holder member collide against the side of the embroidery frame so that various component parts of the needle bar mechanism and fabric holder mechanism are deformed or broken.

SUMMARY OF THE INVENTION

In view of the foregoing, it is an object of the present invention to provide an improved sewing machine which, even when there has occurred a sudden power failure during operation of the machine, can reliably prevent a needle bar of each machine head set in a resting state from undesirably descending, by reliably retaining the needle bar in a jump sewing state.

In order to accomplish the above-mentioned object, the present invention provides an improved sewing machine, which comprises: a needle bar driven to move up and down to perform sewing operation; a jump mechanism electrically controlled to bring the needle bar to a jump sewing state; a holder member controlled to move up and down, in synchronism with up-and-down movement of the needle bar, for holding a sewing workpiece from above when the holder member is in its lowered position; a holder mechanism for, when the sewing operation is to be stopped, moving the holder member upward to a predetermined evacuating position and mechanically retaining the holder member in the evacuating position; and an interlocking mechanism for mechanically retaining the needle bar in the jump sewing state in interlocked relation to the holder member being mechanically retained in the evacuating position.

In order to bring a machine head of the sewing machine to a resting state, the holder mechanism moves the holder member to the evacuating position and mechanically retains the holder member in the evacuating position, in interlocked relation to which the interlocking mechanism mechanically retains the needle bar in the jump sewing state so that the machine head can be placed in the resting state. Thus, even when a power failure has occurred in the sewing machine, the present invention, where the jump sewing state of the needle bar is mechanically retained by the interlocking mechanism, allows the needle bar of the resting machine head to be reliably retained in the jump sewing state without involving unwanted descending movement of the needle bar, thereby effectively avoiding deformation or breakage of component parts that might be caused by collision between the needle bar and a side of an embroidery frame etc.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE PREFERRED EMBODIMENTS

Figure 1:
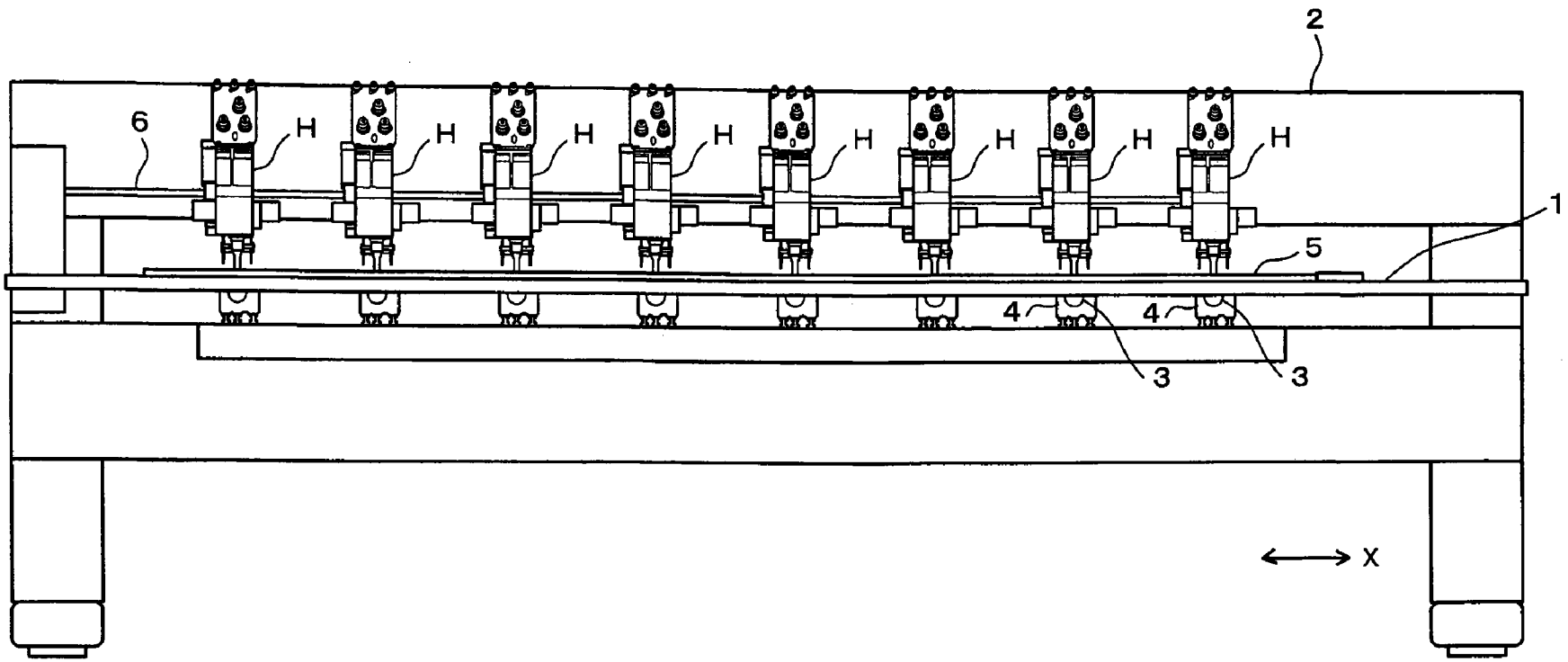
FIG. 1 is a front view showing an outer appearance of a multi-head sewing machine in accordance with an embodiment of the present invention.

The following paragraphs first outline a sewing machine of the present invention. FIG. 1 is a front view showing an outer appearance of an embodiment of the sewing machine of the present invention. According to the instant embodiment, a sewing workpiece to be used comprises a fabric (i.e., base sewing material) and string-shaped sewing materials to be sewn onto the fabric, and the sewing machine of FIG. 1 is a multi-head sewing machine provided with a plurality of (eight in this case) machine heads H each capable of sewing the string-shaped sewing material onto the fabric (base material). FIG. 1 shows the front surface of the multi-head sewing machine as viewed by a human operator actually performing sewing operation etc., that is, it is assumed that a region of the figure closer to a person viewing the figure is where the human operator is located.

In the multi-head sewing machine of FIG. 1, an upper frame 2 is disposed over an elongated machine table 1 extending in a left-right horizontal direction (X direction in the figure), and a plurality of machine heads H are provided on the front surface at equal intervals along the longitudinal direction (X direction in the figure) of the upper frame 2. Under each of the machine heads H, a rotary hook base 4 supporting a rotary hook 3 is provided at the same level or height position as the machine table 1. Sewing frame 5 for holding a sewing workpiece, such as a fabric, in a stretched-taut condition is placed on the upper surface of the machine table 1, and the sewing frame 5 is driven, by a not-shown drive mechanism disposed under the machine table 1, in front-rear and left-right horizontal directions (X and Y directions) in accordance with a desired sewing pattern indicated by sewing pattern data. Common main shaft 6 of the machine extends through the individual machine heads H, and a sewing needle 9 (see FIGS. 3 and 4) of each of the machine heads H is reciprocally driven by the rotation of the common main shaft 6. Through cooperative operation between the sewing needle 9 and the rotary hook 3 rotated by the rotary hook base 4, sewing is performed on the fabric held on the sewing frame 5 in a stretched-taut condition.

Figure 2:
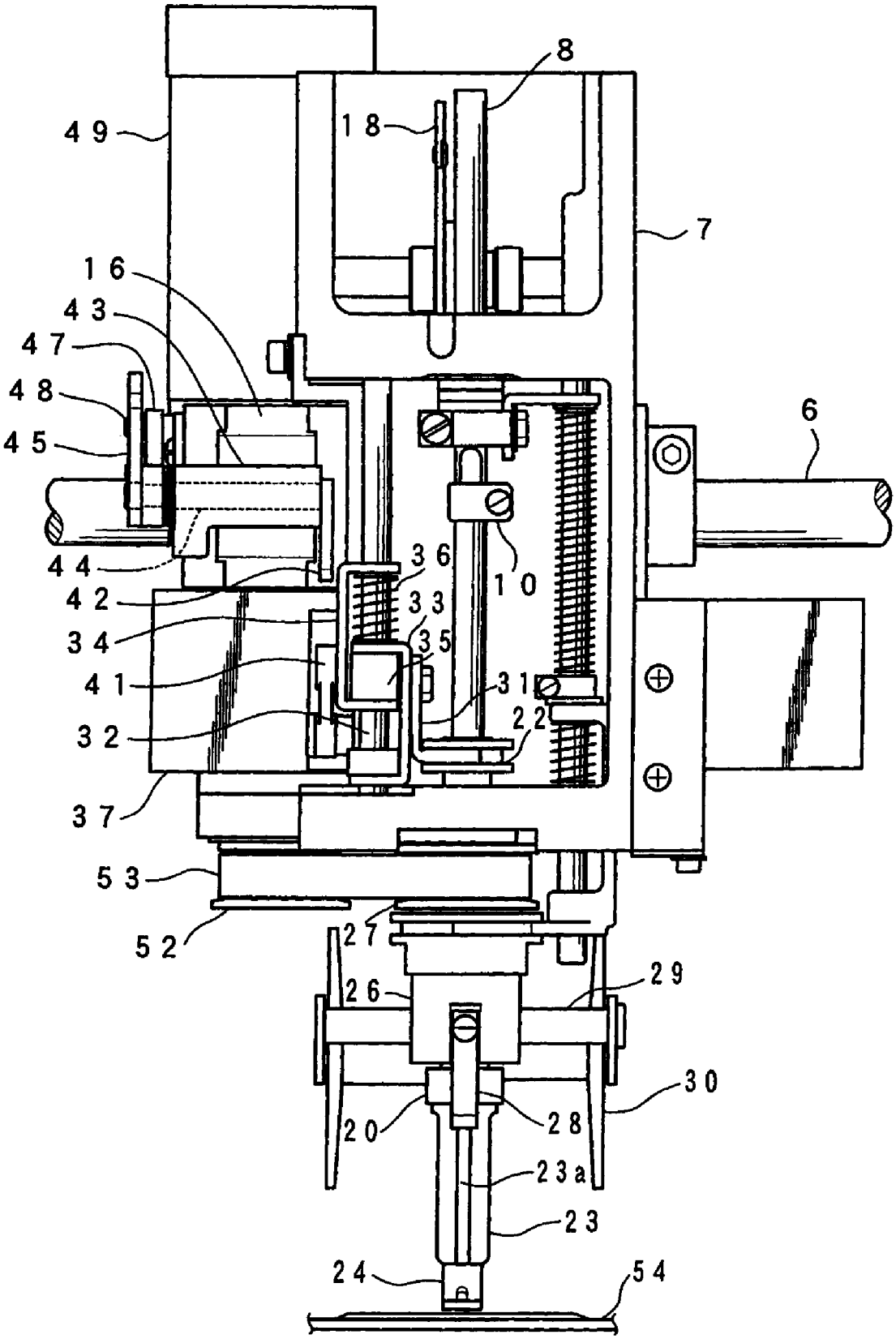
FIG. 2 is a front view of one of the machine heads employed in the multi-head sewing machine shown in FIG. 1.
Figure 3:
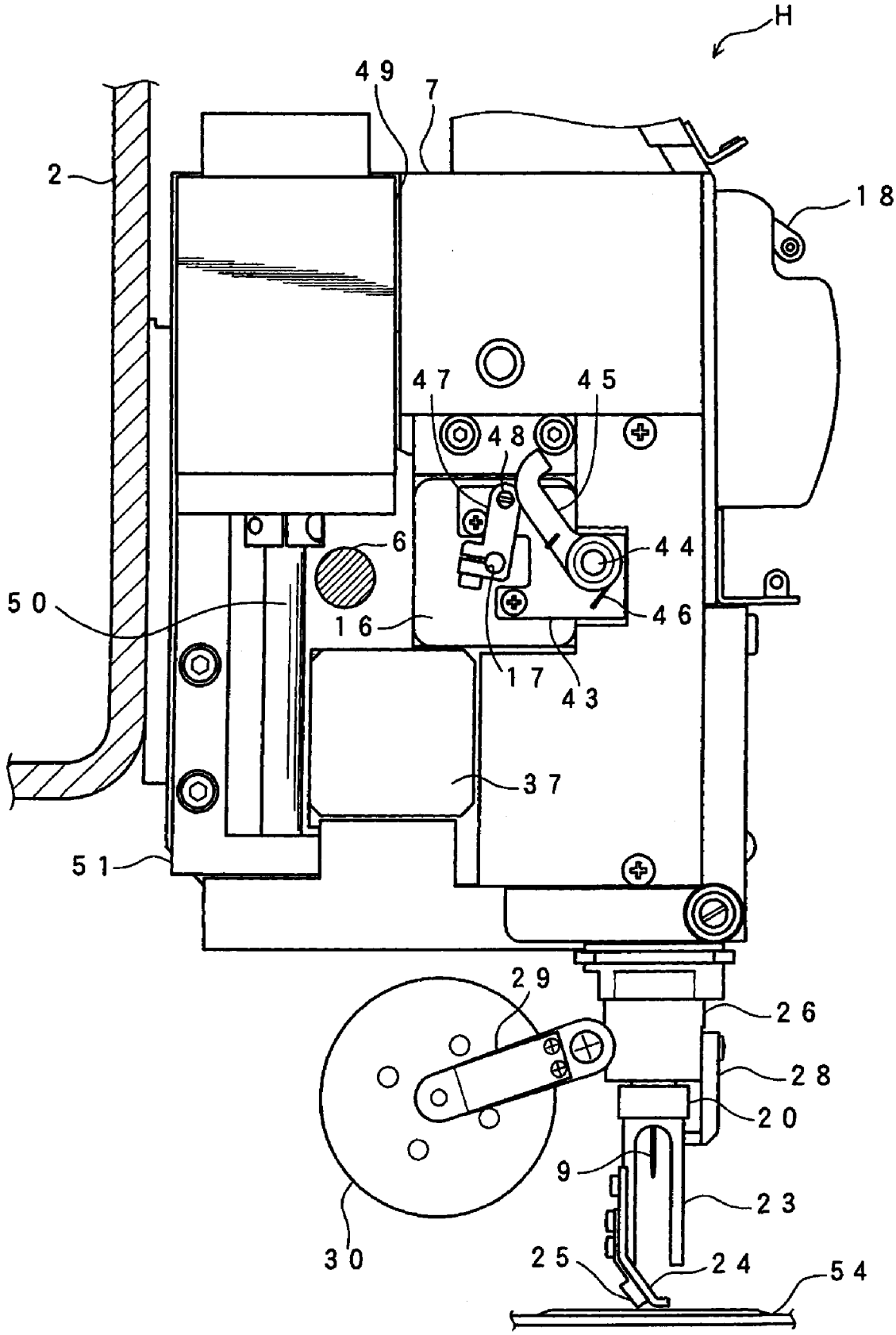
FIG. 3 is a left side view of the machine head.
Figure 4:
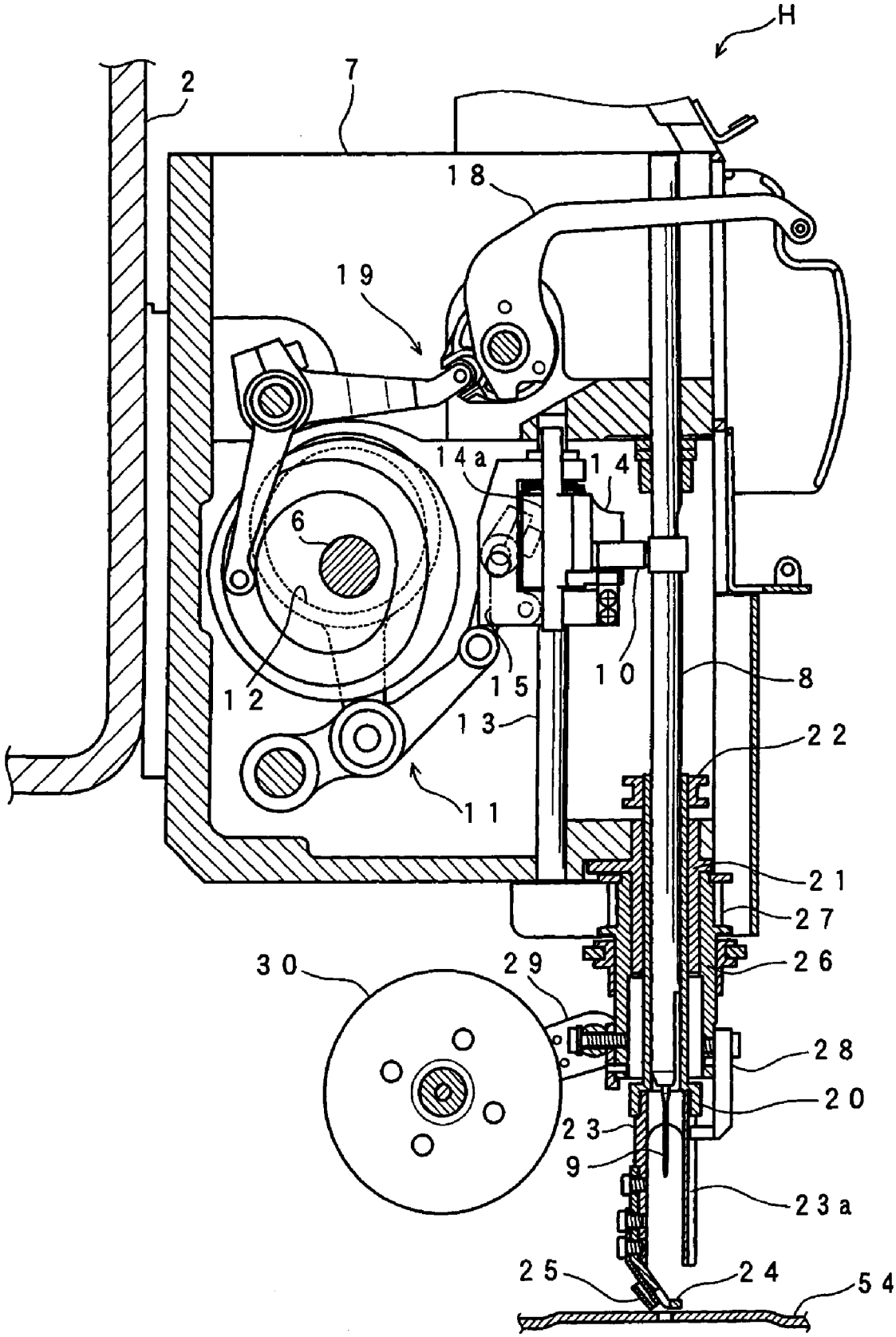
FIG. 4 is a sectional left side view of the machine head.
Figure 5:
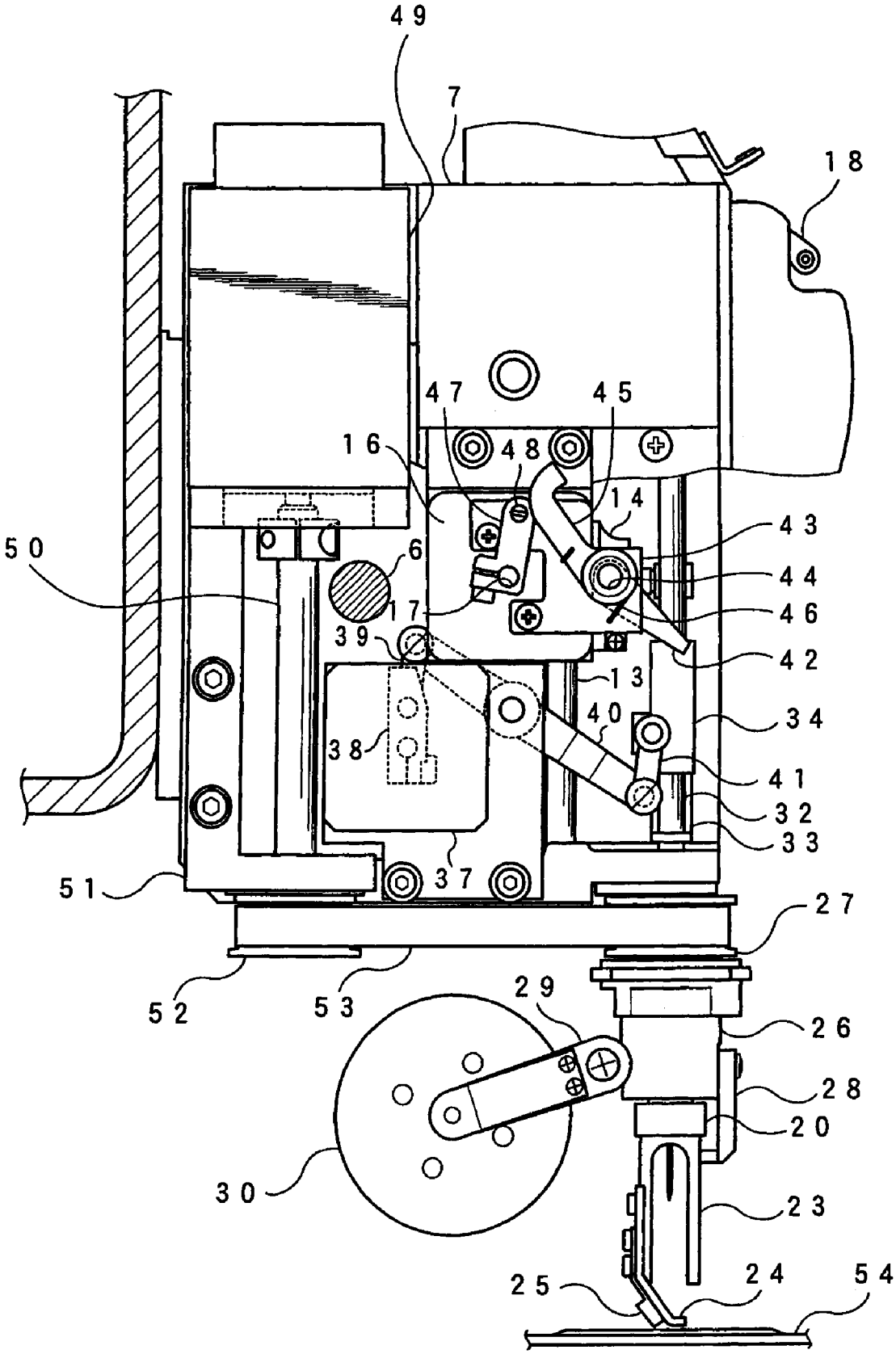
FIG. 5 is a partly-broken-away side view of the machine head with a fabric holder member in a sewing position.
Figure 6:
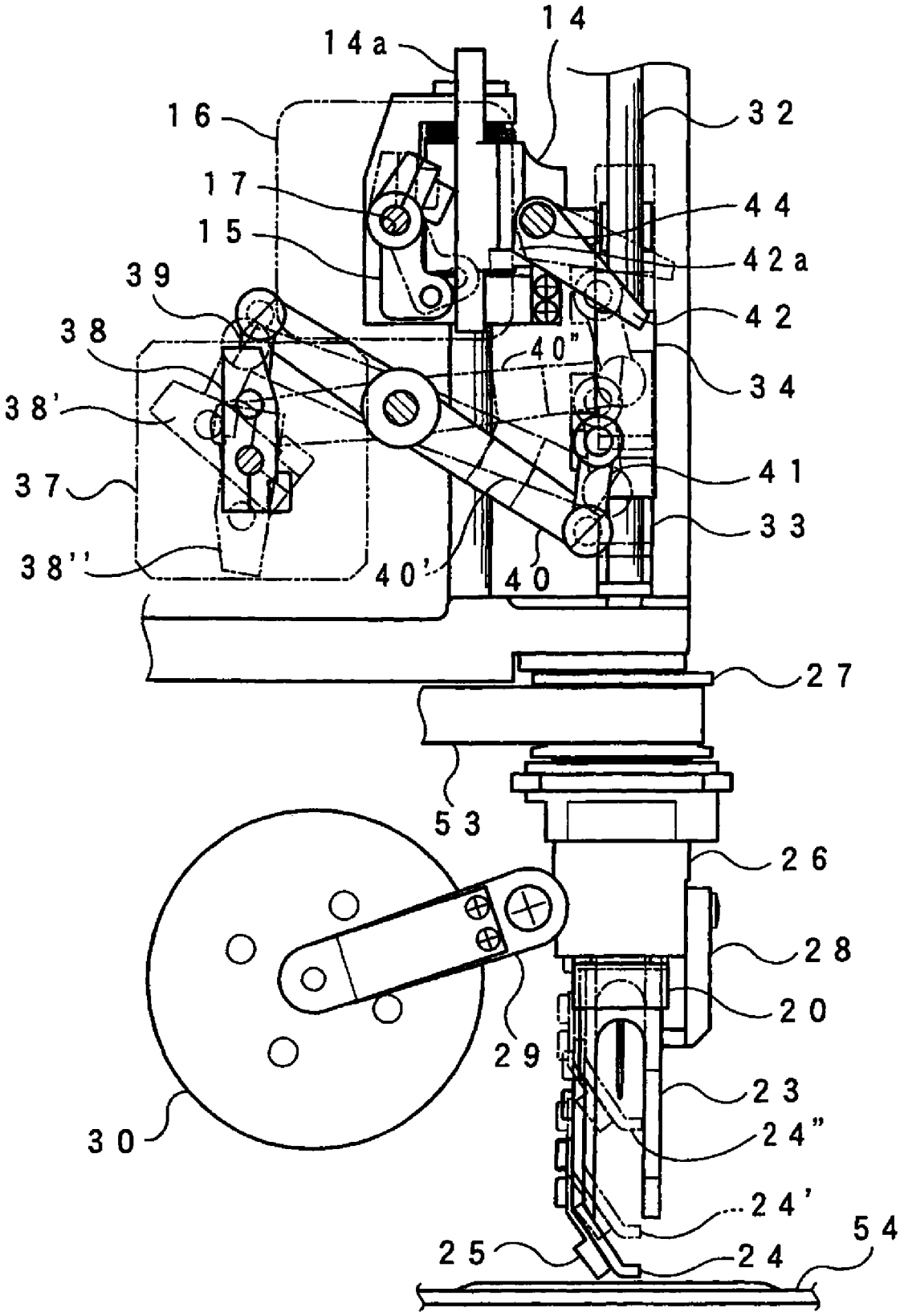
FIG. 6 is a side view showing in enlarged scale a part of FIG. 5.
Figure 7:
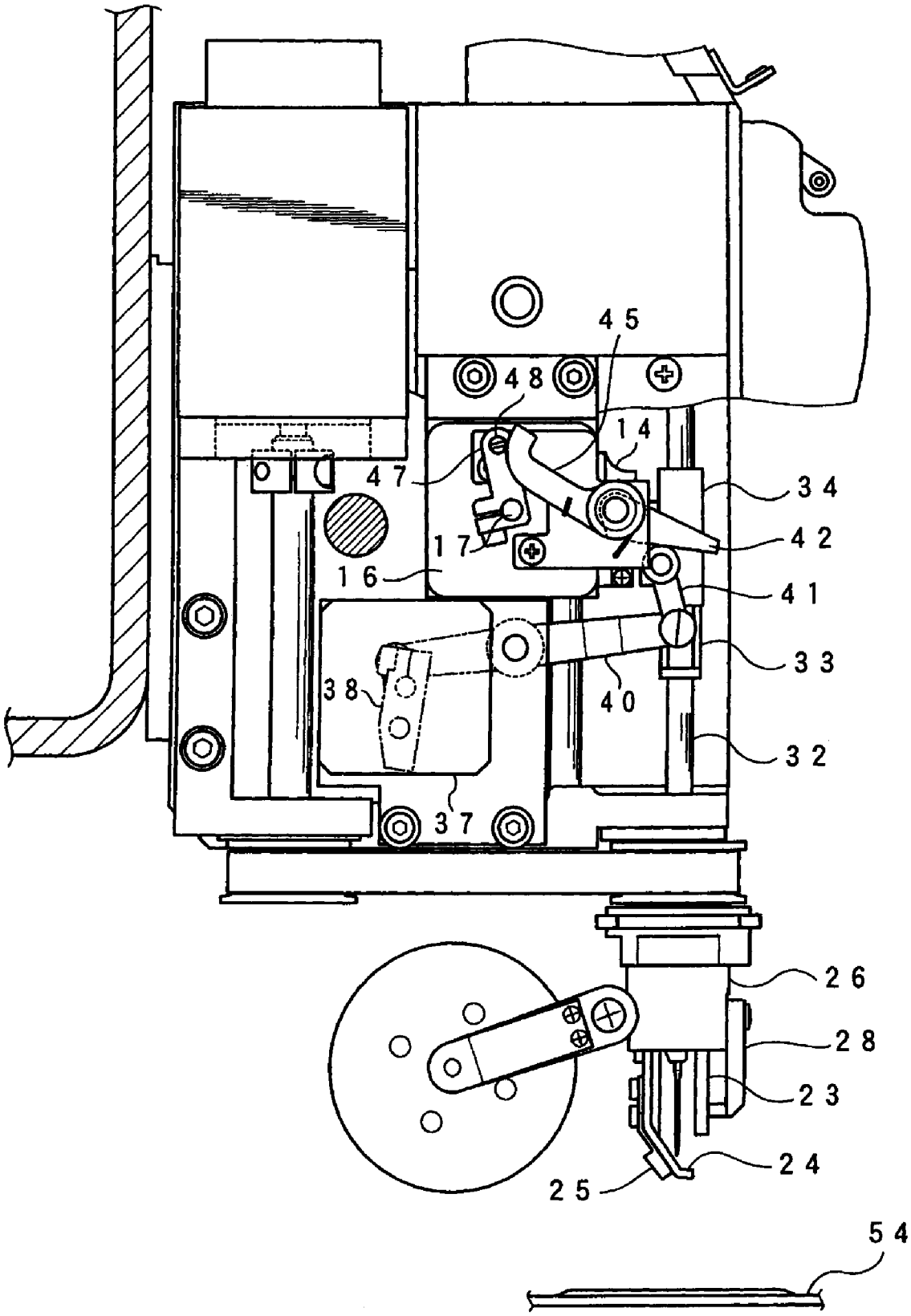
FIG. 7 is a partly-broken-away side view showing the machine head with the fabric holder member in an evacuating position.

Next, a description will be given about the machine heads H employed in the multi-head sewing machine shown in FIG. 1. FIG. 2 is a front view of one of the machine heads H employed in the multi-head sewing machine shown in FIG. 1, FIG. 3 is a left side view of the machine head H, FIG. 4 is a sectional left side view of the machine head H, and FIG. 5 is a partly-broken-away side view of the machine head H. Further, FIG. 6 is a side view showing in enlarged scale a part of FIG. 5. These figures show the machine head H when a fabric holder member 24 is in a sewing position. Further, FIG. 7 is a partly-broken-away side view similar to FIG. 5, but it shows the machine head H when the fabric holder member 24 is in an evacuating position; namely, FIG. 7 shows the machine head H in a resting state. The following paragraphs describe a construction and behavior of the machine head H, with reference to FIGS. 2-7. As seen from these figures, the main shaft 6 of the machine extends through a machine arm 7 of the machine head H, and, on the left side surface of the machine arm 7, there are provided a jump controlling motor (hereinafter referred to as "jumping motor") 16 for performing jump control on a needle bar 8, an lifting/lowering motor 37 for lifting and lowering a fabric holder support member 23, and an orientation controlling motor (hereinafter referred to as "controlling motor") 49 for performing orientation control on the fabric holder support member 23.

As seen from FIG. 4 etc., the needle bar 8 is vertically-movably supported on the machine arm 7. The sewing needle 9 is fixed to the lower end of the needle bar 8, and a needle bar clamp 10 is fixed to a substantial middle portion of the needle bar 8. The needle bar 8 is driven vertically (i.e., in an up-down direction) by a needle bar drive mechanism 11 that is in turn driven by the rotation of the main shaft 6. The needle bar drive mechanism 11 converts rotation of a needle bar cam 12, fixed to the main shaft 6, to vertical movement of an lifting/lowering drive member 14 relative to a vertical guide shaft 13 supported by the machine arm 7 in a vertical orientation, and the vertical movement of the lifting/lowering drive member 14 is transmitted, via the needle bar clamp 10, to the needle bar 8. The lifting/lowering drive member 14 is supported on the vertical guide shaft 13 in such a manner that the drive member 14 is also rotatably about the axis of the guide shaft 13, and the lifting/lowering drive member 14 also has an engaging side surface 14*a* having a predetermined length in the vertical direction.

Drive arm 15 is provided behind the engaging side surface 14*a* of the lifting/lowering drive member 14 and fixed to one end of a shaft 17 of the jumping motor 16 for performing the jump control on the needle bar 8, i.e. for cutting off transmission of a rotational driving force from the main shaft 6 to the needle bar 8 to thereby set the needle bar 8 in the so-called "jump sewing state" such that the needle bar 8 will not move vertically up and down in response to the rotation of the main shaft 6. The jumping motor 16 of each of the machine heads H is controlled, independently of the jumping motors 16 of the other machine heads H, by an electrical jump sewing signal for setting the machine head H in the jump sewing state independently of the jumping motors 16 of the other machine heads H.

The drive arm 15 is normally urged by a not-shown biasing means, such as a spring or rubber, toward a standby position (i.e., position indicated by a solid line in FIG. 6), so that the arm 15 is held in the standby position while the jumping motor 16 is OFF. Once the jumping motor 16 is turned on in response to the jump sewing signal, the drive arm 15 is driven to pivot to a predetermined jump-effecting position (i.e., position indicated by an imaginary or two-dot-dash line in FIG. 6) against the resilient biasing force of the biasing means.

The jump sewing signal is given at predetermined timing when the needle bar 8 is located near its upper dead point. As the drive arm 15 is driven, by the jumping motor 16, to pivot to the predetermined jump-effecting position indicated by the two-dot-dash line in FIG. 6, the engaging surface 14*a* of the lifting/lowering drive member 14 is pressed by the distal end of the drive arm 15, so that the lifting/lowering drive member 14 turns about the axis of the guide shaft 12. Once the drive arm 15 is brought to the jump-effecting position, the needle bar clamp 10 (see FIG. 4) of the needle bar 8 is disengaged from the lifting/lowering drive member 14 so that the rotating driving force transmission from the main shaft 6 is cut off, and thus, the needle bar 8 is brought to the jump sewing state. Then, the jumping motor 16 is kept activated or driven to hold the drive arm 15 in the jump-effecting position, to thereby allow the needle bar 8 to be continuously kept in the jump sewing state. As the jumping motor 16 is turned off or deactivated, the drive arm 15 is brought back to the standby position by the resilient biasing force of the biasing means, and thus, the lifting/lowering drive member 14 is returned, via a not-shown biasing means, to a position to hold the needle bar clamp 10 so as to permit the vertical, up-and-down movement of the needle bar 8. Namely, the machine head H is provided with a jump mechanism for cutting off the rotational driving force transmission from the main shaft 6 to the needle bar 8. Vertical length of the engaging surface 14*a* of the lifting/lowering drive member 14 is set such that the engaging surface 14*a* is always opposed to the distal end of the drive arm 15 through the entire vertical stroke range of the needle bar 8. Thread take-up lever 18 is pivotably supported on the machine arm 7 as well known, and this thread take-up lever 18 is caused to vertically pivot by means of a thread take-up lever drive mechanism 19 that is in turn driven by the rotation of the main shaft 6.

As shown in FIG. 4, a supporting cylinder 20 is provided around the outer periphery of the needle bar 8 in such a manner that it is not only vertically movable relative to the needle bar 8 but also rotatable about the axis of the needle bar 8 while being guided by the inner peripheral surface of a sleeve 21 fixed to a lower portion of the machine arm 7. Ring 22 is fixed to an upper end portion of the supporting cylinder 20, and the fabric holder support member 23 is fixed to a lower end portion of the supporting cylinder 20. The fabric holder support member 23 has a bifurcated shape having opposed leg portions, and one of the opposed leg portions has a vertically-elongated key groove 23*a* in the outer surface thereof while the other of the opposed leg portions has the fabric holder member 24 fixed thereto. Guide member 25 is fixed to the fabric holder member 24, and this guide member 25 functions to direct a string-shaped sewing material, let out from a later-described bobbin 30, toward the point of the sewing needle 9. Rotary cylinder 26 is disposed around the outer periphery of the fixed sleeve 21 in such a manner that the cylinder 26 is only rotatable about its axis. The rotary cylinder 26 has a pulley 27 provided on the outer periphery of an upper end portion of the rotary cylinder 26, and it also has a key member 27 fixed to its lower end portion for fitting engagement with the key groove 23*a*. Further, a bobbin bracket 29 is fixed to the outer periphery of the rotary cylinder 26, and the bobbin 30 for winding thereon the string-shaped sewing material to be sewn onto the fabric is rotatably supported on the bobbin bracket 29.

Next, a description will be given about the fabric holder mechanism for lifting and lowering the above-mentioned fabric holder member 24, with primary reference to FIGS. 2, 5 and 6. As shown in FIG. 2, a distal end portion (fork portion) of a drive arm 31 is held in engagement with the ring 22 of the supporting cylinder 20 in such a manner that the drive arm 31 can transmit a vertical driving force to the ring 22. The drive arm 31 is adjustable in position relative to a lifting/lowering member 33 supported on the vertical guide shaft 32 that is in turn fixed to the machine arm 7. Further, a base lifting/lowering member 34 is supported on the vertical guide shaft 32 in such a manner that the base lifting/lowering member 34 is vertically movable along the guide shaft 32. The lifting/lowering member 33 is not only supported via a block 35 by the base lifting/lowering member 34, but also normally urged, by the resilient biasing force of a spring 36 provided on the guide shaft 32 between the lifting/lowering member 33 and the base lifting/lowering member 34, in a (downward) direction such that the lifting/lowering member 33 is pressed against the block 35.

As shown in FIGS. 5 and 6, a drive lever 38 is fixed to the shaft of the lifting/lowering motor 37 as a drive source for lifting and lowering the fabric holder support member 23, and the drive lever 38 is connected, via a link member 39, at its distal end portion to one end portion of a pivot arm 40 rotatably supported on the machine arm 37. The other end portion of the pivot arm 40 is connected to the above-mentioned base lifting/lowering member 34 via a link member 41. Thus, when the lifting/lowering motor 37 is activated or driven, the pivot arm 40 reciprocally pivots so that the base lifting/lowering member 34 and lifting/lowering member 33 move up and down along the guide shaft 32, and thus, the supporting cylinder 20 moves up and down, via the drive arm 31, together with the fabric holder support member 23 (and hence fabric holder member 24) (see FIG. 2). During sewing, the lifting/lowering motor 37 is controlled to reciprocally rotate in forward and reverse directions, through a predetermined angular range, in response to the rotation of the main shaft 6 of the machine; namely, the driving operation of the lifting/lowering motor 37 is controlled in accordance with a predetermined pattern. By the controlled driving of the lifting/lowering motor 37, the drive lever 38 is driven to reciprocally pivot between a position indicated by a solid line in FIG. 6 and a position 38' indicated by a one-dot-dash line in FIG. 6, in response to which the pivot arm 40 is caused to reciprocally pivot between a position indicated by a solid line in FIG. 6 and a position 40' indicated by a one-dot-dash line in FIG. 6. Further, by the reciprocal pivoting movement of the pivot arm 40, the fabric holder member 24 is driven to move up and down between a lower dead point indicated by a solid line in FIG. 6 and an upper dead point (24') indicated by a one-dot-dash line in FIG. 6. When at the lower dead point, the fabric holder member 24 presses the fabric and string-shaped sewing material from above. Further, when the sewing operation is to be stopped or the machine head H is to be brought to the resting state, the lifting/lowering motor 37 is controlled to assume a predetermined operating position (angular position) to cause the pivot art 40 to pivot to a position 40" indicated by a two-dot-dash line in FIG. 6, in response to which the fabric holder member 24 is evacuated to a position 24" (predetermined evacuating position) indicated by a two-dot-dash line in FIG. 6. The predetermined evacuating position 24" is set above the above-mentioned upper dead point 24'.

Note that the lower dead point of the fabric holder member 24 may be raised depending on the types of the fabric and string-shaped sewing material to be sewn onto the fabric. Such a rise of the lower dead point is appropriately addressed in the instant embodiment by stopping the lowering of the lifting/lowering member 33 once the fabric holder member 24 hits the string-shaped sewing material and thereby allowing only the base lifting/lowering member 34 to be lowered against the resilient biasing force of the spring 36 (see FIG. 2).

Next, a description will be given about an interlocking mechanism for placing the needle bar 8 in the jump state in response to the evacuating operation of the aforementioned fabric holder member 24. As illustratively shown in FIGS. 2 and 5-7, an interlocking lever 42 is provided on an upper left side of the base lifting/lowering member 34. The interlocking lever 42 is pivotally connected to one end of the shaft 44 mounted to the bracket 43 that is in turn fixed to the jumping motor 16 for performing the jump control on the needle bar 8, and an actuating lever 45 is connected to the other end of the shaft 44. Torsion spring 46 is provided between the bracket 43 and the actuating lever 45, and this torsion spring 46 normally urges the actuating lever 45 to pivot clockwise in FIG. 5 or 7. Further, the interlocking lever 42 is provided in such a manner that, when the fabric holder member 24 is in the evacuating position, its distal end portion abuts against the link member 41, as shown in FIG. 7, as the holder member 24 is evacuated to the evacuating position.

By the resilient biasing force of the torsion spring 46, the interlocking lever 42 is normally urged so that its lower proximal end portion **42*a* is located at a pivoted position, as indicated by a solid line in FIG. 6, where it abuts against a side surface of the jumping motor 16 When the interlocking lever 42 is in the above-mentioned pivoted position, the actuating lever 45 is located in a pivoted position as shown in FIG. 5. As the fabric holder member 24 is moved to the evacuating position, the interlocking lever 42 is pressed by the link member 41 to pivot to a position indicated by a two-dot-dash line in FIG. 6, so that the actuating lever 45 pivots to a position as indicated in FIG. 7. Jump lever 47 is fixed to the other end of the shaft 17 of the jumping motor 16, and a pin 48 that can abut against the actuating lever 45 is fixed to the jump lever 47. Thus, as the actuating lever 45 is caused to pivot in response to the evacuating movement of the fabric holder member 24, the pin 48 is pressed by the actuating lever 45 so that the jump lever 47 is caused to pivot counterclockwise to assume a position as shown in FIG. 7. Further, as the jump lever 47 pivots in the aforementioned manner, the drive arm 15 too is caused to pivot, via the shaft 17 of the jumping motor 16, to the jump-effecting position as indicated by a two-dot-dash line in FIG. 6, so that the needle bar 8 is brought to the jump sewing state. In the instant embodiment, where the drive arm 15 is normally held in the jump-effecting position, the needle bar 8 can be brought to the continuous-jump-sewing state even when the jumping motor 16 is kept OFF. In this way, the jump sewing state of the needle bar 8 can be retained mechanically by the aforementioned various component parts (such as the drive lever 38 driven by the lifting/lowering motor 37, link members 39, 41 and pivot arm 40, and the interlocking lever 42, actuating lever 45 and jump lever 47 that operate in response to the operation of the aforementioned lever 38, link members 39, 41 and pivot arm 40**) cooperating as if they were a single-piece retaining unit.

As illustratively shown in FIG. 5, a vertical shaft 50 is connected to the shaft of the controlling motor 49 that functions to control the orientation of the fabric holder member 23, and the shaft 50 has its lower end rotatably supported on a base member 51 that is in turn fixed to the machine arm 7. Driving pulley 52 is fixed to a lower end portion of the shaft 50, and a timing belt 53 is wound on and extends between the driving pulley 52 and the pulley 27 of the rotary cylinder 26. Thus, as the controlling motor 49 rotates in the forward or reverse direction, the rotary cylinder 26 is caused to rotate in the forward or reverse direction, so that the orientations of the fabric holder member 23 and guide 25 can be controlled as desired via the key member 28. As known in the art, the controlling motor 49 and hence the rotating direction and rotating amount (angle) of the rotary cylinder 26 are controlled in accordance with sewing pattern data (embroidery sewing data), in response to which the orientation of the guide 25 is controlled so that the orientation, in the needle point position, of the string-shaped sewing material can be appropriately adjusted to follow the desired sewing pattern.

Note that, in FIGS. 2-7, reference numeral 54 indicates a conventionally-known needle plate fixed to the upper surface of the rotary hook 4.

Next, a description will be given about a sequence of operations performed by the aforementioned multi-head sewing machine for sewing a string-shaped sewing material onto a fabric. In sewing the string-shaped sewing material onto the fabric (base sewing material) by the multi-head sewing machine constructed in the aforementioned manner, the bobbin 30 having the string-shaped sewing material wound thereon is set on the bobbin bracket 29 of each of the machine heads H, and the string-shaped sewing material is let out from each of the bobbins 30 and directed through the guide 25 toward the point of the sewing needle 9 (i.e., needle point). In the meantime, the fabric is set in advance on the sewing fabric 5 in a stretched-taut condition. Once the sewing machine is activated by the human operator operating a start switch of the sewing machine, the main shaft 6 of the machine is rotated to drive the needle bar 8 (sewing needle 9) and thread take-up lever 18 vertically up and down. By the driving of the lifting/lowering motor 37, the fabric holder member 24 is driven to vertically move between the solid-line position and one-dot-dash position of FIG. 6 in synchronism with the up-and-down movement of the needle bar 8. Rotation of the rotary cylinder 26 is controlled by the controlling motor 49 so that the bobbin 30 and guide 25 are controlled or adjusted in orientation to be always located forward of the needle as viewed in a sewing-progressing direction. Further, the rotary hook 3 is rotated in synchronism with the up-and-down movement of the needle bar 8 (sewing needle 9) and the sewing frame 5 is driven in the front-rear and left-right horizontal directions, so that the string-shaped sewing material is sewn onto the fabric held on the sewing frame 5 in a stretched-taut condition. When the needle bar 8 is to be jumped for jump sewing operation during the sewing of the string-shaped sewing material onto the sewing workpiece, the jump sewing signal is given to the jumping motor 16 as set forth above.

The following paragraphs describe a sequence of operations performed when only one or some of the plurality of machine heads are caused to operate with the remaining machine heads set in the resting state, as well as a sequence of operations performed when any one of the machine heads having so far been kept in the resting state is brought to the operating state.

When any one of the machine heads H is to be brought to the resting state, driving operation control is performed on only the lifting/lowering motor 37 for moving the fabric holder member 24, corresponding to the machine head H to be brought to the resting state, to the evacuating position, with the jumping motor 16 of the machine head H in question kept in the deactivated or OFF state. Namely, for the machine head H to be brought to the resting state, a motor drive control signal is given to cause the lifting/lowering motor 37 to rotate counterclockwise beyond the above-mentioned forward/reverse reciprocal rotation range so that the drive lever 38 takes a predetermined operating position 38" indicated by a two-dot-dash line in FIG. 6, in response to which the pivot arm 40 and fabric holder member 24 are evacuated to the respective positions 40" and 24" (evacuating positions) indicated by the two-dot-dash lines in FIG. 6. As the fabric holder member 24 is moved to the evacuating position, the interlocking lever 42 is pressed by the link member 41 to thereby rotate together with the actuating lever 45, and thus, the actuating lever 45 presses the pin 48 so that the jump lever 47 is caused to pivot. Thus, the drive arm 15 is caused to pivot to the position indicated by the two-dot-dash line in FIG. 6, to thereby bring the needle bar 8 to the jump sewing state. With such operation of the interlocking lever 42, the needle bar 8 can be set in the jump sewing state in interlocked relation to the fabric holder member 24 moving to the evacuating position without the jumping motor 16 being activated or driven.

Namely, the instant embodiment is constructed in such a manner that, when the fabric holder member 24 is in the evacuating position, the shaft of the lifting/lowering motor 37, connecting portion between the distal end portion of the drive lever 38 and the link member 39 and connecting portion between the link member 39 and the pivot arm 40 are located in "near-straight" vertical alignment (so-called "dead point") as indicated by the two-dot-dash lines in FIG. 6 or 7, and thus, the fabric holder member 24 can be retained in the evacuating position. Although the interlocking lever 42 and actuating lever 45 are normally urged by the torsion spring 46 in the clockwise direction of FIG. 7, the resilient biasing force of the torsion spring 46 is blocked by the link member 41 so that the interlocking lever 42 and actuating lever 45 can be held in the respective positions as illustrated in FIG. 7, and thus, the needle bar 8 can be mechanically retained in the jump sewing state. Once the jump sewing state of the needle bar 8 is mechanically held in the aforementioned manner, the jump sewing state can thereafter be reliably retained mechanically even when the lifting/lowering motor 37 for the fabric holder member 23 has been turned off or deactivated and, of course, even if the jumping motor 16 is kept in the OFF state. Therefore, even when a sudden power failure has occurred while the machine head H is set in the resting state, the needle bar 8 can be reliably retained in the jump sewing state with no particular inconvenience involved.

Note that, because the shaft of the lifting/lowering motor 37, connecting portion between the distal end portion of the drive lever 38 and the link member 39 and connecting portion between the link member 39 and the pivot arm 40 are located in "near-straight" vertical alignment rather than in "exactly-straight" vertical alignment while the fabric holder member 24 is in the evacuating position, the aforementioned component parts could undesirably descend together with the lower the needle bar 8 when a strong force has been applied due to descending movement of the needle bar 8, as discussed above in relation to the relevant prior art. However, the instant embodiment can reliably prevent undesired descending of the needle bar 8 even in case of a power failure, because the jump sewing state of the needle bar 8 can be reliably retained through the aforementioned mechanical retaining arrangements.

On the other hand, when any one of the machine heads H having so far been in the resting state is to be brought to the operating state, a motor drive control signal (resting-state-canceling electrical signal) is given to drive the corresponding lifting/lowering motor 37 in a predetermined direction so that the fabric holder member 24 is lowered to the upper dead point indicated by the one-dot-dash line in FIG. 6 by the driving force of the lifting/lowering motor 37. Thus, the interlocking lever 42 and actuating lever 45 are caused to pivot, by the biasing force of the torsion spring 46, to the respective positions indicated in FIG. 5 so that the actuating lever 45 is brought out of the abutting engagement with the pin 48 of the jump lever 47 and the pivot arm 15 is caused to pivot, via the biasing means, to the solid-line position of FIG. 6; in this manner, the mechanically-retained jump sewing state of the needle bar 8 is canceled.

As a second embodiment of the present invention, a jump signal may also be temporarily given to the jumping motor 16 of the machine head H to be brought to the resting state, in addition to the drive control performed on the lifting/lowering motor 37 for moving the fabric holder 24, corresponding to the to-be-rested machine head H. In such a case, the jump sewing state of the needle bar 8 may be mechanically retained by first temporarily placing the needle bar 8 in the jump sewing state via the jumping motor 16 and then activating the lifting/lowering motor 37. In this way, it is possible to considerably reduce a load imposed on the lifting/lowering motor 37 when the fabric holder member 24 is to be moved to the evacuating position.

The above-described multi-head sewing machine of the present invention can be summarized as follows. Namely, as the fabric holder member 24 is moved to the evacuating position in order to rest any one of the machine heads H, the jump mechanism operates, via the interlocking mechanism (comprising the interlocking lever 42, bracket 43, actuating lever 45, torsion spring 46, jump lever 47 and pin 48), to place the needle bar in the jump sewing state. Further, even when a power failure has occurred, the needle bar 8 can be reliably retained in the jump sewing state by the fabric holder member 24 being retained in the evacuating position. Namely, the jumping motor 16 need not be activated or driven when the any one of the machine heads H is to be rested, and, of course, the jumping motor 16 need not be kept activated during the resting period of the machine head H as was the case with the conventional sewing machines. Therefore, even when a power failure has occurred in the sewing machine of the present invention, the needle bar 8 of each resting machine head H can be reliably retained in the jump sewing state, and the fabric holder member 24 too can be reliably prevented from undesirably descending; thus, the present invention can effectively prevent the fabric holder member from colliding against a side of the embroidery frame (not shown), thereby avoiding possible deformation or breakage of any of the component parts caused by the collision.

Note that the interlocking mechanism is not limited to the construction described above in relation to the preferred embodiments and may be constructed in any desired manner as long as it allows the needle bar 8 to be retained in the jump sewing state even in case of a power failure. In short, the interlocking mechanism employed in the present invention may be of any construction as long as it can perform appropriate jump sewing control, in response to the driving of the jumping motor 16, when the machine head is to be brought to the operating state and can reliably mechanically retain the needle bar 8 in the jump sewing state, irrespective of the driving state of the jumping motor 16, when the machine head is to be brought to the resting state.

Further, the preferred embodiments have been described above in relation to the case where, when any one of the machine heads H having so far been in the resting state is brought back to the operating state, the jump sewing state of the needle bar 8 is canceled by the driving of the lifting/lowering motor 37. However, the present invention is not necessarily so limited, and any other desired mechanism controllable electrically or mechanically may be used for the cancellation of the jump sewing state of the needle bar 8.

Whereas the preferred embodiments have been described above as applied to the multi-head sewing machine equipped with only the machine heads H capable of sewing string-shaped sewing materials, the basic principles of the present invention may also be applied to only machine heads H capable of sewing string-shaped sewing materials in another type of multi-head sewing machine having the string-material-sewing machine heads and embroidering machine heads arranged alternately.

Furthermore, the application of the present invention is not limited to sewing machines capable of sewing string-shaped sewing materials; in short, the basic principles of the present invention may be applied to any other types of sewing machines including a needle bar jumping mechanism and sewing workpiece holder member whose up-and-down movement is controlled in synchronism with up-and-down movement of a corresponding needle bar.

What is claimed is:

1. A sewing machine comprising:

a needle bar driven to move up and down to perform sewing operation;

a jump mechanism electrically controlled to bring said needle bar to a jump sewing state;

a holder member controlled to move up and down, in synchronism with up-and-down movement of said needle bar, for holding a sewing workpiece from above when said holder member is in a lowered position;

a holder mechanism for, when the sewing operation is to be stopped, moving said holder member upward to a predetermined evacuating position and mechanically retaining said holder member in the evacuating position; and an interlocking mechanism for mechanically retaining said needle bar in the jump sewing state in interlocked relation to said holder member being mechanically retained in the evacuating position.

2. A sewing machine as claimed in claim 1 wherein said jump mechanism includes a motor electrically driven when said needle bar is to be brought to the jump sewing state, and a member movable to a predetermined jump-effecting position in response to driving of said motor, said member bringing said needle bar to the jump sewing state when said member is in the jump-effecting position, and wherein said interlocking mechanism transmits, to said member, movement of said holder mechanism when mechanically retaining said holder member in the evacuating position, to thereby mechanically retain said member in the jump-effecting position.

3. A sewing machine as claimed in claim 1 wherein said holder mechanism includes:

an electric motor controlled, during the sewing operation, in a predetermined pattern in synchronism with the up-and-down movement of said needle bar, said electric motor being controlled to take a predetermined operating position when the sewing operation is to be stopped; and a driving/retaining mechanism responsive to driving of said electric motor during the sewing operation for driving said holder member to move up and down between predetermined upper and lower dead points, said driving/retaining mechanism being also responsive to driving of said electric motor when the sewing operation is to be stopped for moving said holder member to the evacuating position above the upper dead point to thereby mechanically retain said holder member in the evacuating position.

4. A sewing machine as claimed in claim 1 wherein, when mechanical retainment, by said holder mechanism, of said holder member in the evacuating position is canceled, said interlocking mechanism cancels mechanical retainment, in the jump sewing state, of said needle bar in interlocked relation to movement of said holder member away from the evacuating position.

5. A sewing machine as claimed in claim 1 wherein said sewing workpiece comprises a string-shaped sewing material and a base sewing material onto which the string-shaped sewing material is to be sewn.

6. A sewing machine as claimed in claim 5 which further comprises:

a rotary member rotatable about an axis of said needle bar; and a guide rotatable together with said rotary member to direct a string-shaped sewing material toward a needle point, wherein rotation of said rotary member is controlled in accordance with sewing data to thereby control an orientation of said guide, so that a directing direction of the string-shaped sewing material in a needle point position is variably controlled in accordance with the sewing data.

7. A sewing machine as claimed in claim 1 which includes a plurality of machine heads and further includes, for each of said machine heads, said needle bar, said jump mechanism, said holder, said holder mechanism and said interlocking mechanism.

* * * * *